US005458059A

United States Patent [19]

Ishii

[11] Patent Number: 5,458,059

[45] Date of Patent: Oct. 17, 1995

[54] PRINTING MACHINE FOR PIECES OF PRINTING PAPER

[75] Inventor: Koji Ishii, Fuchu, Japan

[73] Assignee: Ryobi Limited, Fuchu, Japan

[21] Appl. No.: 377,001

[22] Filed: Jan. 23, 1995

Related U.S. Application Data

[62] Division of Ser. No. 154,301, Nov. 18, 1993, Pat. No. 5,415,088.

[30] Foreign Application Priority Data

Dec. 17, 1992 [JP] Japan ..... 4-337390

[51] Int. Cl.[6] ..... B41L 45/00

[52] U.S. Cl. ..... 101/76; 101/232

[58] Field of Search ..... 101/76, 77, 84, 101/85, 183, 226, 409, 232, 247, 248; 270/21.1; 83/300

[56] References Cited

U.S. PATENT DOCUMENTS

| | | | |
|---|---|---|---|
| 4,068,582 | 1/1978 | Poitras et al. | 101/247 |
| 4,426,929 | 1/1984 | Fujisawa et al. | 101/76 |
| 4,480,545 | 11/1984 | Fujisawa et al. | 101/183 |
| 4,524,962 | 6/1985 | Davenport et al. | 270/21.1 |
| 4,756,245 | 7/1988 | Roch | 101/76 |
| 4,805,111 | 2/1989 | Steidel | 101/248 |
| 4,805,501 | 2/1989 | Nuttin | 83/300 |
| 4,936,214 | 6/1990 | Overholser | 101/226 |
| 4,960,048 | 10/1990 | Sarda | 101/247 |

*Primary Examiner*—Eugene H. Eickholt
*Attorney, Agent, or Firm*—Brooks & Kushman

[57] ABSTRACT

A printing machine in which a perforation pressure drum is disposed downstream of a paper feeding section, and a longitudinal perforation blade and a lateral perforation blade may be brought into contact with the perforation drum. A delivery drum is in contact with the perforation drum, and a numbering pressure drum is in contact with the delivery drum. A numbering box may be brought into contact with the numbering pressure drum. With such an arrangement, it is possible to enhance printing position precision and operational property.

2 Claims, 2 Drawing Sheets

PRINTING MACHINE FOR PIECES OF PRINTING PAPER

This is a divisional Ser. No. 08/154,301 filed on Nov. 18, 1993 now U.S. No. 5,3415,088.

BACKGROUND OF THE INVENTION

The present invention relates to a number printing machine, and more particularly to a number printing machine which is capable of perform a number printing and a perforation.

In general, a printing machine having both a number printing function and a perforation function.

In this type conventional printing machine, a pressure drum is provided downstream of a paper feed section. A rubber drum comes into contact with the pressure drum. A printing drum is in contact with the rubber drum. A water supply unit and an ink supply unit are brought into contact with the printing drum. A delivery drum is provided on the pressure drum, and a numbering pressure drum is brought into contact with the delivery drum. A lateral perforation blade for forming a lateral perforation, a longitudinal perforation blade for forming a longitudinal perforation and a numbering box are brought into contact with the numbering pressure drum. Furthermore, a paper discharge section is provided downstream of the numbering pressure drum. An ink feeder for numbering is used to supply the numbering box with ink.

A drum attachment paper is tensioned so as to come into intimate contact with the numbering pressure drum by a tension mechanism (not shown) with its one end being attached by screws to a drum attachment paper fixing member provided in a recess formed in the numbering pressure drum, and with the other end being fixed to a fastening bar. A lateral perforation band (not shown) corresponding to the above-described lateral preformation blade is provided in the axial direction of the numbering pressure drum on an outer periphery of the drum attachment paper, whereas a longitudinal perforation band corresponding to the longitudinal perforation blade is wound in the circumferential direction on the outer periphery of the drum attachment paper and is made of polished steel plate. One end of the longitudinal perforation band made of steel is clamped by longitudinal band fasteners. The other end of the longitudinal perforation band is provided with a number of retainer holes. A spring is hooked at one of the retainer holes for applying a tension to the longitudinal perforation band.

The lateral perforation blade, the longitudinal perforation blade and the numbering box are finely arranged relative to the numbering pressure drum So that a delicate contact pressure may be obtained.

In the printing machine with such an arrangement, however, as described above, the lateral and longitudinal perforation bands corresponding, respectively, to the lateral and longitudinal blades are provided with a tension on the drum attachment paper in the lateral and longitudinal directions, and in addition, in many cases, the lateral and longitudinal perforation bands are made of steel with a thickness of 0.5 mm. As a result, the bands projects on the drum attachment paper by a distance corresponding to the thickness of the bands. When the printing paper is delivered on the numbering pressure drum, the printing paper is subjected to corrugations by the projection of the lateral perforation band when the longitudinal perforation is formed by the longitudinal perforation blade and by the projection of the longitudinal perforation band when the lateral perforation is formed by the lateral perforation blade. Thus, the paper is not kept exactly fit to the numbering pressure drum. Thus, the prior art machine suffers from a defect that the misaligned or serpentine perforation would appear in the printing paper.

Also, when the numbers are printed on the printing paper on the numbering pressure drum by the numbering box, the printing paper would be lifted or floated by the respective perforation bands in the same manner and would be subjected to the corrugation. It is thus difficult to obtain a good numbering print with high positional precision.

Furthermore, in the above-described arrangement, since the three functional units such as a lateral perforation blade, a longitudinal perforation blade and a numbering box are located in a narrow space so as to surround the numbering pressure drum, the operational property would be worse and it takes a long time to adjust or set these units in place. In addition, since the numbering pressure drum is come into alignment with the numbering box only when the paper is fed to the numbering pressure drum, the adjusted pressure between the lateral perforation blade and the numbering pressure drum is varied due to the movement of the numbering pressure drum.

SUMMARY OF THE INVENTION

In view of the foregoing defects inherent in the prior art printing machines, an object of the present invention is to provide a number printing machine which insures operational property and high precision in number printing.

In order to attain this and other objects, according to the present invention, there is provided a printing machine for pieces of printing paper, comprising a paper feeding section for feeding the paper, a paper conveyor means for delivering the paper, a working section for performing a numbering print, a longitudinal perforation and a lateral perforation on the paper fed from the paper feeding section through the conveyor means, and a paper discharging section for discharging the paper on which the numbering print, the longitudinal perforation and the lateral perforation have been effected, wherein the working section including a perforation pressure drum, a delivery drum and a numbering pressure drum for performing the numbering print, and the delivery drum is interposed between the perforation pressure drum and said numbering pressure drum.

A piece of paper fed from the paper feeding section is delivered through the conveyor means to the perforation pressure drum. In the perforation pressure drum, the longitudinal and lateral perforations are carried out without using any perforation bands. The printing paper fed to the numbering pressure drum through the delivery drum is subjected to a number print by the numbering box and then is discharged to the discharging section. It is possible to effect at least one of the lateral and longitudinal perforation in the numbering pressure drum.

DESCRIPTION OF THE PREFERRED EMBODIMENTS

One embodiment of the present invention will now be described.

Figure 1:
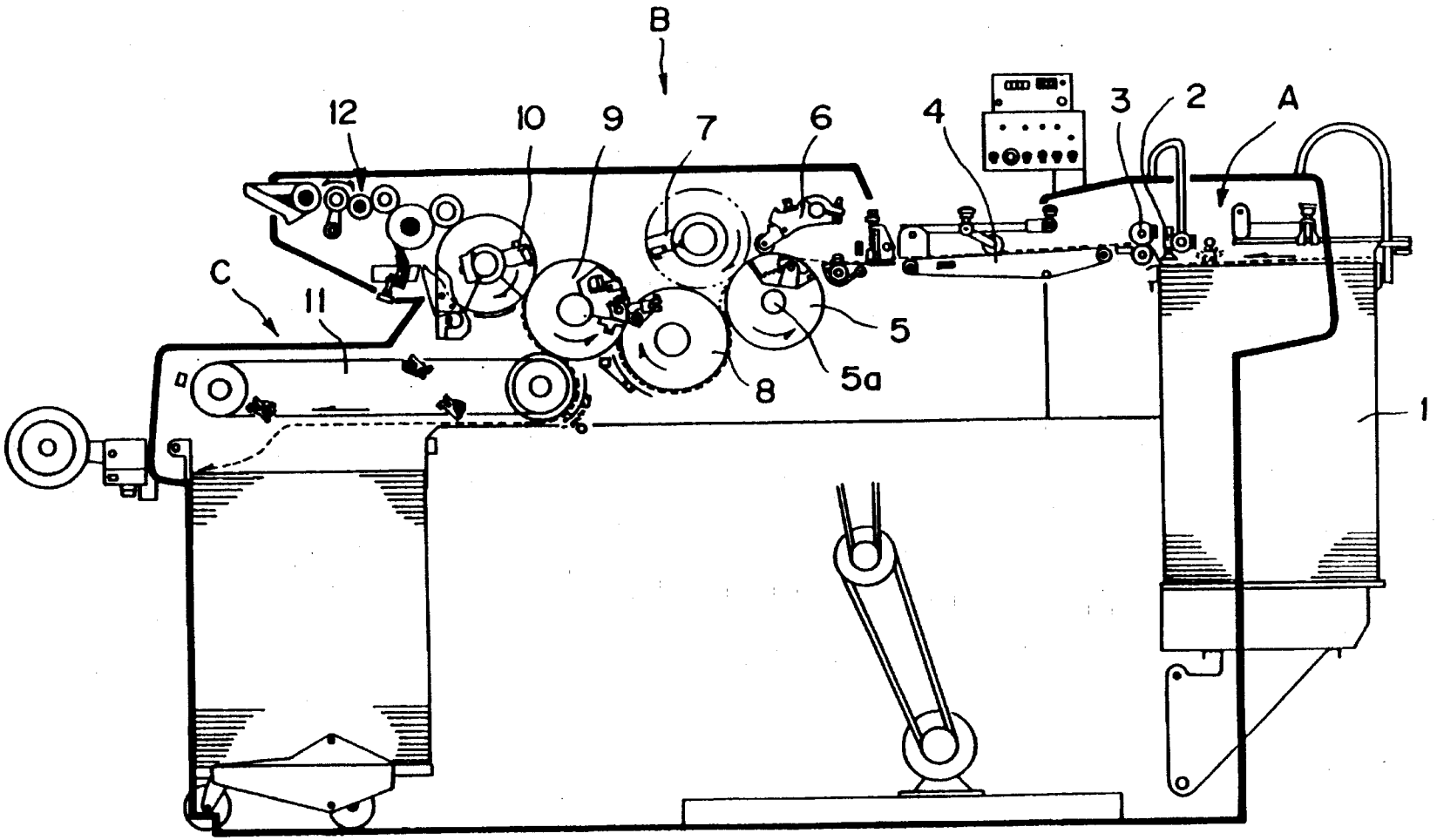
FIG. 1 is an elevational cross-sectional view showing a number printing machine according to a first embodiment of the invention.

FIG. 1 is a side elevational sectional view showing a number printing machine according to the present invention. The number printing machine includes a paper feed section A for feeding pieces of paper into the printing machine, a working section B for performing a perforation and a number print, and a paper discharge section C for discharging pieces of paper. A suction unit 2 is provided in the paper feeding section A for picking up pieces of paper one by one. A pair of pickup rollers 3 are disposed downstream of the suction unit 2 (on the left side). A conveyor belt 4 is provided for conveying a paper 2, picked up by the pickup rollers 3, to the working section B. A perforation pressure drum 5 which is rotatable on a shaft 5*a* but kept at a stationary position is disposed downstream of the conveyor belt 4. A longitudinal perforation blade 6 and a lateral perforation blade 7 are provided in the vicinity of the perforation pressure drum 5 to be capable of contacting with the latter. A delivery drum 8 is in contact with the perforation pressure drum 5, and in turn the numbering pressure drum 9 is in contact with the delivery drum 8. A numbering box 10 is provided at a position opposite to the delivery drum 8 with respect to the numbering pressure drum 9 so that the numbering box 10 may contact against the numbering pressure drum 9. A paper discharging chain 11 is provided below the numbering pressure drum 9 in the paper discharging section C. Reference numeral 12 denotes an ink supply section for supplying an ink to the numbering box 10. Incidentally, in order to prevent the perforation pressure drum 5 from being damaged by the perforation blades 6 and 7, the perforation pressure drum 5 is subjected to a hardening process such as quenching.

The operation of the thus constructed number printing machine will be explained.

The pieces of printing paper 1 are sucked in order from the upper position one by one by the suction unit 2 and are delivered to the conveyor belt 4 by the pickup rollers 3. The paper 1 fed to the conveyor belt 4 is delivered to the vicinity of the perforation pressure drum 5 in the working section B and is clamped by the perforation pressure drum 5. The longitudinal perforation and the lateral perforation are effected by the longitudinal perforation blade 6 and the lateral perforation blade 7, respectively, during the delivery action of the perforation pressure drum 5. At this time, since the shaft 5*a* of the perforation pressure drum 5 is rotatably supported to the frame of the printing machine, the drum insertion or drum removal could not be performed. The perforation pressure drum 5 is kept at a stationary position, and thus the longitudinal perforation blade 6 may be located so as to be adjusted to an accurate adjustment pressure relative to the perforation pressure drum 5. In the same manner, the lateral perforation blade 7 may be located so as to be adjusted in the same manner to obtain an accurate adjustment pressure. Accordingly, it is always possible to perform the perforation at a constant pressure. Since the numbering box 10 is located far away from the perforation section, the space of the perforation units is not so restricted. Thus, the positional adjustment of the perforation units may readily be carried out. Furthermore, the perforation pressure drum 5 is made of steel to have a high quenching strength and a tempering strength. It is therefore possible to carry out the perforation without using any longitudinal or lateral band. Thus, the printing paper 1 would not be subjected to corrugation. The perforation may be accurately performed without fail. The printing paper 1 which has been perforated during the rotation of the perforation pressure drum 5 is delivered to the delivery drum 8 and further delivered to the numbering pressure drum 9. During the rotation of the numbering pressure drum 9, the number printing is effected by the numbering box 10. Neither lateral perforation blade 7 nor longitudinal perforation blade 6 is brought into contact with the numbering pressure drum 9. Thus, it is possible to dispense with the lateral and longitudinal perforation bands. The printing paper no longer takes a wavy motion. The printing paper is delivered in intimate contact with the numbering pressure drum 9. It is thus possible to accurately and clearly perform the number printing. Even if the numbering pressure drum 9 is of the type which the drum is entered or removed relative to the numbering box 10, since it is only necessary to effect the dimensional adjustment of the numbering pressure drum 9 relative to the numbering box 10, a fine adjustment may readily be effected with high precision. Then, the printing paper 1 which has been subjected to the numbering print is delivered from the numbering pressure drum 9 to the discharging chain 11 to be discharged.

Incidentally, although, in the foregoing embodiment, both longitudinal perforation blade 6 and lateral perforation blade 7 are provided for forming both the longitudinal and lateral perforations, it is of course possible to apply the present invention to the case where only one of the lateral and longitudinal perforations is carried out.

Figure 2:
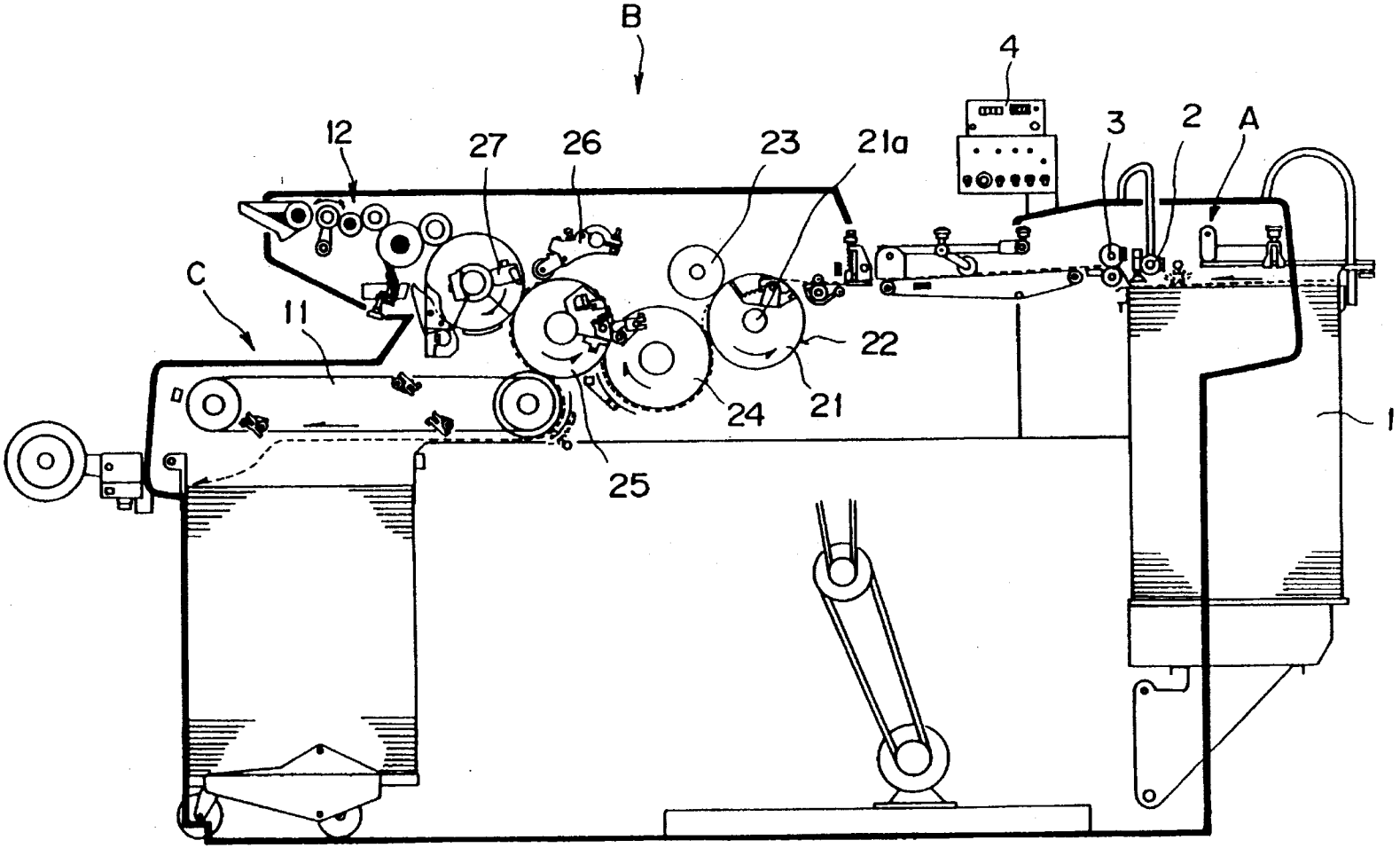
FIG. 2 is an elevational cross-sectional view showing a number printing machine according to a second embodiment of the invention.

FIG. 2 is a side elevational view showing a number printing machine in accordance with the second embodiment. In this embodiment, the same reference numerals are used to indicate the same members and components as those shown in FIG. 1 and hence explanation therefor will be omitted. A lateral perforation blade 22 is provided on an outer peripheral portion of the perforation pressure drum 21 by an adhesive tape. A perforation roller 23 made of elastic material such as, for example, rubber and plastics in the form of a cylinder. The lateral perforation is formed in the printing paper 1 on the lateral perforation blade 22 by depressing the printing paper 1 against the perforation roller 23 by the lateral perforation blade 22. Also, in this case, only the perforation roller 23 needs the dimensional adjustment relative to the perforation pressure drum 21. It is therefore easy to effect the fine adjustment. Also, since the lateral perforation band is not needed, the printing paper no longer rises or takes a wavy motion. It is possible to accurately perforate the paper. Also, since the perforation blade is depressed from the perforation pressure drum 21 to the perforation roller 23, it is unnecessary to effect a surface hardening by heat treatments such as quenching or tempering to the perforation pressure drum 21. A delivery drum 24 is brought into contact with the perforation pressure drum 21 and inturn a numbering pressure drum 25 is brought into contact with the delivery drum 24. A longitudinal perforation blade 26 and a numbering box 27 are located above the numbering pressure drum 25. A longitudinal perforation band (not shown) is provided with tension for mating with the longitudinal perforation blade 26. A drum attachment paper (not shown) is provided between the longitudinal perforation band and the numbering pressure drum 25 for contact between a numbering box 27 and the numbering pressure drum 25. Accordingly, although the printing paper 1 is somewhat lifted by the longitudinal perforation band, what is to be contacted with the numbering pressure drum 25 is only the numbering box 27 and the longitudinal perforation blade 26. Accordingly, in comparison with the conventional arrangement, it is possible to accurately carry out the numbering print and the longitudinal perforation. A paper discharging chain 11 is provided in the vicinity of the numbering pressure drum 25 in the paper discharging section C. Incidentally, since the perforation blade 22 is attached to the perforation pressure drum 21, it is unnecessary to effect the hardening treatment such as quenching as in the first embodiment.

As has been described above, according to the present invention, the perforation pressure drum for forming the perforation and the numbering pressure drum for effecting the numbering print are separately provided through the delivery drum, so that the perforation and the number print are effected at separate special positions, respectively. The perforation pressure drum may be rotated but stationary at a position. It is therefore easy to carry out the dimensional adjustment and pressure adjustment between perforation blade and the perforation pressure drum. Since the perforation pressure drum may be kept unchanged in position, its position is not misaligned. It is possible to perform the perforation at a constant pressure to thereby ensure the formation of an clear and aligned perforation. Also, no perforation band is used on the perforation pressure drum, and hence there is no fear that the printing paper would be lifted or floated and the printing paper would not take any wavy motion. Since with respect to each of the adjustment work, the longitudinal perforation blade, the lateral perforation blade and the numbering box are not located concentratedly on the numbering pressure drum, the space may be utilized widely and the adjustment work may readily be attained. Thus, it is possible to enhance the positional precision of the number printing.

What is claimed is:

1. A printing machine for pieces of printing paper, comprising a paper feeding section for feeding the paper, a paper conveyor means for delivering the paper, a working section for performing a numbering print, a longitudinal perforation and a lateral perforation on the paper fed from said paper feeding section through said conveyor means, and a paper discharging section for discharging the paper on which the numbering print, the longitudinal perforation and the lateral perforation have been effected, wherein said working section including a perforation pressure drum, a delivery drum and a numbering pressure drum for performing the numbering print, and said delivery drum is interposed between said perforation pressure drum and said numbering pressure drum.

2. The printing machine according to claim 1, wherein said perforation pressure drum is made of quenched steel.

* * * * *